United States Patent [19]

Colegrove

[11] 4,144,107

[45] Mar. 13, 1979

[54] GELLED EXPLOSIVE COMPOSITIONS

[75] Inventor: George T. Colegrove, San Diego, Calif.

[73] Assignee: Merck & Co., Inc., Rahway, N.J.

[21] Appl. No.: 868,259

[22] Filed: Jan. 10, 1978

[51] Int. Cl.[2] ..... C06B 31/30

[52] U.S. Cl. ..... 149/60; 149/61; 149/109.6

[58] Field of Search ..... 149/44, 60, 109.6, 61, 149/19.1

[56] References Cited

U.S. PATENT DOCUMENTS 4,055,450 10/1977 Sujansky ..... 149/60

*Primary Examiner*—Stephen J. Lechert, Jr.

*Attorney, Agent, or Firm*—Gabriel Lopez; Richard A. Thompson; Julian S. Levitt

[57] ABSTRACT

This invention relates to a gelled explosive and a method for its preparation. More specifically, the invention relates to a gelled explosive composition containing water, at least one member selected from the group of a polysaccharide colloid and synthetic polymer; water-soluble melamine resin and a water-soluble explosive salt.

11 Claims, No Drawings

GELLED EXPLOSIVE COMPOSITIONS

BACKGROUND OF THE INVENTION

This invention relates to a gelled explosive composition and a method for its preparation. More specifically, the invention relates to a gelled explosive composition containing water, at least one selected from the group of a polysaccharide and synthetic polymer; water-soluble melamine resin and a water-soluble explosive salt.

Various explosives are known which are supplied in the form of a gel. Such gelled explosives have not been entirely satisfactory because of gel instability. The gel instability has been manifested by syneresis and bleeding of the gel after a relatively short period of time. Also, such gels have been produced by heavy metal cross-linking of polysaccharides wherein said reactions are difficult to control and are often unpredictable. The timing is often critical in order to permit filling operations to occur before gelation proceeds.

DESCRIPTION OF THE INVENTION

An object of this invention is to provide gelled explosives which are characterized by their stability and a firm, tough and cohesive nature of their gel structure.

Another object of this invention is to provide a composition wherein gelation occurs only in the final container. An added advantage is that the cross-linking agent is an organic compound and is combustible.

A further object of the invention is to provide a method of making a stable, tough, cohesive gelled explosive.

Additional objects will become apparent from a reading of the specification and claims which follow.

In accord with the invention, a gelled explosive is formed by adding to water at least one member selected from the group of a polysaccharide colloid and synthetic polymer; a water-soluble melamine resin, and a water-soluble explosive salt.

The explosive salt which is employed is soluble in water and can be an acid, basic or neutral salt. The practical explosive salts are those which contain a high quantity of oxygen so as to provide a favorable oxygen balance in the explosive. Typical of the salts that may be utilized in this invention are ammonium nitrate, sodium nitrate, potassium nitrate, calcium nitrate and the like.

The quantity of explosive salt which is employed can be varied widely while still obtaining a gelled explosive. To illustrate, gels have been utilized by using as low as 5% by weight of explosive salt in the gelled composition. In order to obtain a favorable oxygen balance in the explosive, it is, of course, desirable to employ a much larger quantity of the explosive salt. A suitable quantity can, for example, be as high as about 90% by weight of the gelled composition. The only limitation on the quantity of explosive salt which is used is its solubility in water. The water temperature is a factor affecting its solubility and increased solubility can be obtained simply by heating the water to which the salt is added. In the process, it is found that warming the water to a temperature from about 40 to about 80° C. greatly improves the solubility of the salt, the quantity of which in turn determines the oxygen balance in the final explosive.

The amount, by weight, of each component is based on the total amount of all the components in the total composition. The total composition consists of water, polysaccharide colloid and/or synthetic polymer; melamine resin, explosive salt, sensitizing agents such as organic nitrates, a fuel or aerating agent, and powdered aluminum to increase energy and act as a sensitizer.

Present in the explosive composition is a water-soluble resin such as a melamine derivative. The melamine resins allow the explosive composition's gelation to occur within several hours to a day depending upon temperature and pH. Thus, one can prepare the explosive composition in a mixing container and pump or transfer the composition to another container where the final gelation occurs. The concentration of the melamine resin can be employed over a wide range. The gel strength of the composition will depend on the melamine resin concentration. Thus, the higher the melamine resin concentration, the higher the gel strength. The content of melamine resin can range from about 5 to about 250% by weight of the polysaccharide colloid or synthetic polymer or combination of the two. A more preferred range would be from about 25% to about 100% by weight of the polysaccharide colloid or synthetic polymer or a combination of the two.

The melamine resins utilized in the present invention are well known and commercially available from American Cyanamid Resin Department, Wayne, N.J. Included among the melamines utilized in the instant invention are the polymerization reaction products of melamine and formaldehyde which have been partially methylated. The melamine resins utilized in the instant invention may be described as partially methylated melamine formaldehyde resins, or hexamethoxymethyl melamine resins (e.g. Cymel 370, Cymel 380, Cymel 373, Cymel 303, etc.).

The polysaccharide colloids that can be utilized in this invention are those that can be cross-linked into a gel formation by a melamine resin. Those polysaccharide colloids that may be included herein are guar gum, hydroxypropyl guar, carboxymethyl guar, carboxymethyl hydroxypropyl guar, xanthan gum, locust bean gum, tragacanth gum, alginates and the like. The preferred polysaccharide colloids that may be utilized herein are xanthan gums and guar gums or combinations of the two. Synthetic polymers can also be utilized alone or in combination with the polysaccharide colloids. The preferred synthetic polymers are partially hydrolyzed polyacrylamides. The content of the polysaccharide and synthetic polymer alone or in combination can range from about 0.5% to about 3.0% by weight of total composition.

Among the ingredients set forth above, the gelled explosives also contain water. In forming a gelled explosive according to the invention, the various ingredients are added to water. The order of addition of the ingredients is not critical, however, it is preferred that the melamine resin be added last. Thus, for example, the polysaccharide colloid may be first dissolved in the water and then the soluble explosive salt followed by the melamine resin may be added or the polysaccharide colloid may be dissolved directly in an aqueous solution of the explosive salt and the melamine salt. Further, the polysaccharide colloid may be co-dissolved with either the soluble melamine resin compound or with the soluble explosive salt.

To facilitate formation of the explosives, it is desirable that the various ingredients employed be in a finely divided form. As stated previously, it is oftimes desirable to heat the water which also facilitates solution of the various ingredients therein. In order to obtain a homogeneous explosive, it is also desirable to agitate the water mixture. Following addition of the last ingredient, whether melamine resin, explosive salt, polysaccharide colloid, or synthetic polymer, the composition then can be placed where it may finally be utilized and will form a gel upon standing.

The rate of gelation of the composition is affected by the pH of the composition. That is, the addition of acidic compounds can increase the rate of gelation. Acids that can be utilized in this invention are organic and inorganic acids. Illustrations of the acids that can be used are nitric acid, sulfuric acid, hydrochloric acid, formic acid, p-toluene sulfonic acid and the like.

The following examples are capable of wide variation and modification, and any minor departure or extension is considered as being within the skill of the artisan and as falling within the scope of this invention.

EXAMPLE 1

A 60% ammonium nitrate solution is prepared by adding 600 g. of ammonium nitrate to 390 g. of water, and 10 g. of xanthan gum is dissolved therein to produce 1.0% xanthan gum. The solution is heated to 60° C. to completely dissolve the components and is then divided into two, 500-g. portions. To one 500-g. portion is added 2.0g. of Cymel 373, and 5.0 g. of Cymel 373 is added to the other portion. Both solutions are permitted to gel and equilibrate 24 hours before testing the gel strength using the Instron, Model 1122. The lower level (0.2%) produces a gel strength of 176 g./cm$^2$, while at the 1.0% concentration, the gel is very hard with a gel strength of 654 g./cm$^2$.

EXAMPLE 2

Five (5.0) g. of guar gum are dissolved in 500 g. of 60% ammonium nitrate aqueous solution at 60° C. Cymel 373 in the amount of 3.75 g. is added and completely dissolved. The solution is permitted to cool and is tested after 24 hours, at which time a firm gel is observed having a gel strength of 666 g./cm$^2$.

EXAMPLE 3

In order to show improved freeze-thaw stability of the present composition, a gel produced by reaction with chromium is compared with a gel made with Cymel 373 resin. To 500 g. of 60% ammonium nitrate solution containing 5.0 g. of xanthan gum is added 0.75 g. of sodium dichromate followed by 0.75 g. of sodium hydrosulfite. A firm gel is rapidly produced. To a similar 500-g. solution of ammonium nitrate except for the sodium dichromate and sodium hydrosulfite, is added 3.75 g. of Cymel 373 resin. After the gel is formed, both gels are subjected to repeated freezing and thawing cycles. The composition gelled with chromium shows heavy syneresis, or loss of liquid from the gel after three cycles, while the system gelled with Cymel 373 shows no syneresis even after 10 cycles.

What is claimed is:

1. A gelled explosive containing water, at least one member selected from the group of polysaccharide colloid and synthetic polymer; a water-soluble melamine resin and a water-soluble explosive salt.

2. A gelled explosive according to claim 1 wherein at least one member selected from the group of polysaccharide colloid and synthetic polymer is from about 0.5% to 3% of the total composition by weight, the water-soluble resin is from about 5% to 100% of at least one selected from the group of polysaccharide and synthetic polymer by weight and the explosive salt is from about 5% to 90% by weight of the total composition.

3. The composition of claim 1 wherein said explosive salt is ammonium nitrate.

4. The composition of claim 1 wherein said polysaccharide colloid is at least one member selected from the group consisting of xanthan gum, guar gum, guar gum derivatives, locust bean gum, tragacanth gum and alginates.

5. The composition according to claim 1 wherein the synthetic polymer is partially hydrolyzed polyacrylamides.

6. The composition according to claim 1 wherein the polysaccharide colloid is at least one member selected from the group consisting of xanthan gum, guar gum and guar gum derivatives.

7. The composition of claim 1 wherein said resin is at least one selected from the group of hexamethoxymethyl melamine resin and partially methlated melamine formaldehyde resin.

8. A method for forming a gelled explosive composition comprising mixing water, at least one member selected from the group of a polysaccharide colloid and synthetic polymer; a water-soluble melamine resin and a water-soluble explosive salt.

9. A method according to claim 6 wherein at least one member selected from the group of polysaccharide colloids and synthetic polymers is from about 0.5% to 3.0% by weight of the total composition, the resin is from about 5% to 100% by weight of at least one member selected from the group of polysaccharides and synthetic polymers; and the explosive salt is from about 5% to 90% by weight of the total composition.

10. A method according to claim 6 wherein the polysaccharide colloid is at least one member selected from the group consisting of xanthan gum, guar gum, guar gum derivatives, locust bean gum, tragacanth gum and alginates.

11. A method according to claim 6 wherein the synthetic polymer is partially hydrolyzed polyacrylamides.

* * * * *